US006074254A

United States Patent [19]

Schultz et al.

[11] Patent Number: 6,074,254

[45] Date of Patent: Jun. 13, 2000

[54] COMMUNICATION SYSTEM AND COMMUNICATION CABLE CONNECTOR ASSEMBLY

[75] Inventors: Jeff Schultz, Fort Wayne; John K. Marsh, Wolcottville, both of Ind.

[73] Assignee: Dekko Engineering, Inc., Kendallville, Ind.

[21] Appl. No.: 09/173,368

[22] Filed: Oct. 15, 1998

Related U.S. Application Data

[63] Continuation-in-part of application No. 09/028,135, Feb. 23, 1998.

[51] Int. Cl.[7] ..... H01R 25/00

[52] U.S. Cl. ..... 439/638; 439/676

[58] Field of Search ..... 439/65, 76, 502, 439/638, 654, 660, 668, 676, 709, 712

[56] References Cited

U.S. PATENT DOCUMENTS

| | | | |
|---|---|---|---|
| 504,464 | 9/1893 | Balsley . | |
| 4,829,564 | 5/1989 | Jarvis | 439/701 |
| 5,149,277 | 9/1992 | LeMaster | 439/207 |
| 5,160,276 | 11/1992 | Marsh et al. | 439/502 |
| 5,586,914 | 12/1996 | Foster, Jr. et al. | 439/676 |
| 5,596,169 | 1/1997 | Baker et al. | 174/33 |
| 5,618,185 | 4/1997 | Aekins | 439/76.1 |
| 5,651,701 | 7/1997 | Chen | 439/607 |
| 5,679,027 | 10/1997 | Smith | 439/676 |
| 5,719,933 | 2/1998 | Welch | 439/638 |

*Primary Examiner*—Khiem Nguyen
*Attorney, Agent, or Firm*—Taylor & Aust, P.C.

[57] ABSTRACT

A communication cable connector assembly includes a first connector, a second connector, a first breakout connector and a second breakout connector. The first connector has a plurality of first terminals. The second connector has a plurality of second terminals with a plurality of pairs of adjacent terminals. Each of the plurality of second terminals mate with a corresponding one of the plurality of first terminals. A first subset of the pairs of adjacent terminals define first breakout terminal pairs which are non-adjacent relative to each other. A second subset of the pairs of adjacent terminals define second breakout terminal pairs which are non-adjacent relative to each other. A first breakout connector associated with the second connector has a plurality of third terminals connected with the first breakout terminal pairs of the second connector. A second breakout connector associated with the second connector has a plurality of fourth terminals connected with the second breakout terminal pairs of the second connector.

15 Claims, 8 Drawing Sheets

COMMUNICATION SYSTEM AND COMMUNICATION CABLE CONNECTOR ASSEMBLY

CROSS REFERENCE TO RELATED APPLICATIONS

This is a continuation-in-part of U.S. patent application Ser. No. 09/028,135 filed Feb. 23, 1998.

BACKGROUND OF THE INVENTION

1. Field of the Invention

The present invention relates to electrical connectors, and, more particularly, to communication cable connectors for use with local area networks and/or telephones.

2. Description of the Related Art

Wiring systems for use in modular office systems, such as for use in modular wall partitions and furniture, typically are formed as modular systems with discrete electrical components which interconnect in a plurality of configurations. Such a wiring system may be used to provide electrical power and/or communication signals to a work space. The communication signals may correspond to voice (i.e., telephone) signals and/or data (i.e., local area network or computer modem) signals.

A wiring arrangement for providing communication signals in the form of telephone and/or data signals is described in U.S. Pat. No. 5,160,276 (Marsh, et al.), which has been reassigned to the assignee of the present invention. Disclosed thereby is a wiring arrangement in which a male and female mating connector pair associated with each workstation includes breakout terminal pairs for an RJ-45 connector arranged in a stepped manner from one workstation to another. The RJ-45 connector is connected via a jumper cable to a corresponding access port in a face plate mounted to an exposed surface within the workstation. The access port may be, e.g., another RJ-45 connector in the face place.

The stepped wiring arrangement allows the same terminal pairs of each associated mating connector to be connected with the RJ-45 connector. In particular, the RJ-45 connector includes 4 terminal pairs (i.e., eight terminals) which are respectively connected with terminals 1–8 of an associated mating connector.

The four terminal pairs, i.e., terminals 1–8, are disposed side-by-side relative to each other within the mating connector.

Although U.S. Pat. No. 5,160,276 (Marsh, et al.), is clearly a step forward in the art, the present inventors have recognized that still further improvements can be made. To wit, industry standards require that crosstalk between adjacent wire pairs be maintained at or below a predetermined level. Each wire pair is typically provided as a twisted wire pair, with the twist functioning to substantially eliminate crosstalk with an adjacent wire pair. However, at the points where the wires of each wire pair are connected with the terminals of the mating connector, the wires must necessarily be untwisted to allow for attachment with the associated terminals. At the attachment points with the mating connector, the wires are no longer twisted and the probability for crosstalk to occur increases. Moreover, to reduce the physical size of the connector, the spacing between adjacent terminals is maintained as small as possible and typically is only a few thousandths of an inch. Since the four twisted wire pairs are sequentially attached to eight adjacent terminals in a row of terminals of the connector, and since the terminals are maintained as close as possible to each other to reduce the physical size of the mating connector, crosstalk between adjacent wire pairs may occur to some extent.

What is needed in the art is a communication system for voice and/or data signals which not only allows for the efficient breakout of terminal pairs for an RJ-45 connector associated with each mating connector pair of a workstation, but also effectively reduces crosstalk between adjacent terminals and twisted wire pairs.

SUMMARY OF THE INVENTION

The present invention provides a communication cable connector assembly having breakout terminal pairs which are positioned non-adjacent relative to each other to thereby minimize crosstalk between twisted wire pairs.

The invention comprises, in one form thereof, a communication cable connector assembly including a first connector, a second connector and a first breakout connector. The first connector has a plurality of first terminals. The second connector has a plurality of second terminals with a plurality of adjacent pairs of terminals. Each of the plurality of second terminals mate with a corresponding one of the plurality of first terminals. A plurality of the adjacent pairs of terminals define breakout terminal pairs which are non-adjacent relative to each other. A first breakout connector associated with the second connector has a plurality of third terminals associated with the breakout terminal pairs of the second connector.

An advantage of the present invention is that crosstalk between twisted wire pairs in the communication system is minimized.

Another advantage is that the connectors are wired with a stepped pinout sequence which provides predetermined locations for the breakout terminal pairs within the mating connector.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
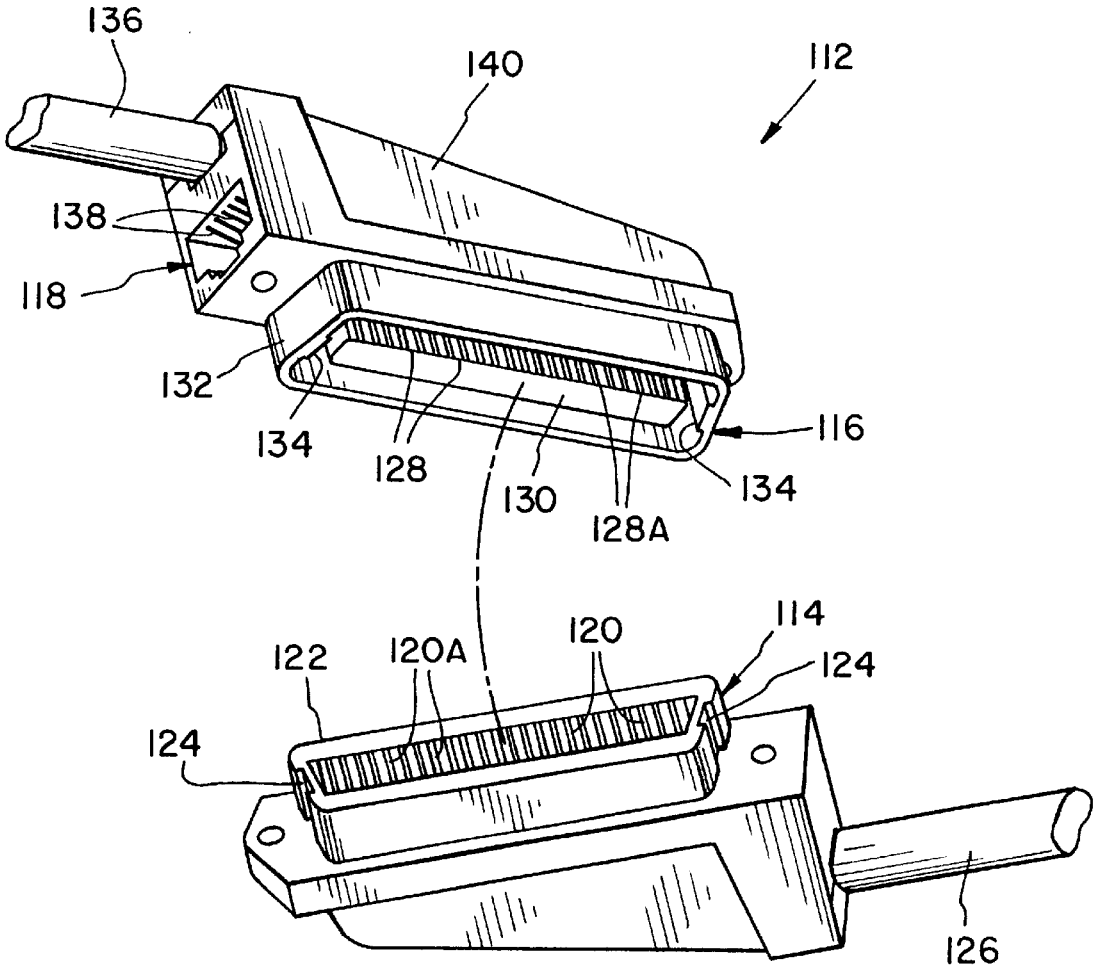
FIG. 1 is a perspective view of one embodiment of a communication connector assembly of the present invention including a male and female connector in a disassembled state.

Referring now to the drawings, and more particularly to FIGS. 1–4, there is shown an embodiment of a communication system 110 of the present invention (FIGS. 2 and 4), including an embodiment of a communication cable connector assembly 112 of the present invention (FIGS. 1–4).

Communication cable connector assembly 112 (FIG. 1) includes a first connector 114, a second connector 116 and a first breakout connector 118. First connector 114 and second connector 116 are configured to mate together, as will be described in further detail hereinafter.

First connector 114 includes a plurality of first terminals which are arranged in two longitudinal rows of terminals which are laterally adjacent to each other, one row of which is visible in FIG. 1 and referenced as 120. The one row of first terminals 120 are arranged on an inside wall of a projection 122 having keys 124. The opposing row of first terminals (not visible) are arranged on the opposite and substantially parallel inside wall of projection 122. First terminals 120 are arranged in a plurality of adjacent pairs of terminals, such as terminal pair 120A, with the two terminals of each terminal pair being respectively connected with a corresponding two wires of a twisted wire pair in a plurality of twisted wire pairs (not shown in FIG. 1) carried within cable 126.

Second connector 116 includes a plurality of second terminals which are arranged in two longitudinal and laterally adjacent rows of terminals, one row of which is referenced as 128 in FIG. 1. Second terminals 128 are mounted in two substantially parallel rows on opposite sides of a center projection 130. Center projection 130, with second terminals 128 mounted thereon, in turn is surrounded by a wall 132 with keys 134. When first connector 114 and second connector 116 are plugged together, center projection 130 fits within the opening defined by projection 122 such that first terminals 120 engage respective second terminals 128. Wall 132 surrounds projection 122, with keys 134 fitting within keys 124.

Second terminals 128 are arranged in a plurality of adjacent pairs of terminals, such as terminal pair 128A in FIG. 1. The individual terminals of each terminal pair are connected with corresponding wires of a twisted wire pair in a plurality of twisted wire pairs (not shown in FIG. 1) carried within cable 136. The two terminals of each terminal pair, such as terminal pair 128A, are arranged longitudinally adjacent to each other within the two rows of second terminals 128.

First breakout connector 118, in the embodiment shown, is in the form of an RJ-45 connector allowing connection of an appropriate electrical device, such as a telephone or computer, with communication cable connector assembly 112. For example, a face plate 164 (FIG. 4) having a similar RJ-45 connector may be provided within an exposed surface in the workstation, and a patch cable 166 may be used to interconnect the RJ-45 connector at the face plate with RJ-45 connector 118 of second connector 116 located within a modular office partition associated with the workstation. RJ-45 connector 118 includes a plurality of third terminals which are connected with corresponding terminal pairs 128A of second connector 116. In the embodiment shown, RJ-45 connector 118 includes eight third terminals 138 which are respectively connected with four terminal pairs 128A of second connector 116. RJ-45 connector 118 and second connector 116 are each carried by a common housing 140 for purposes of compactness and neatness.

Figure 2:
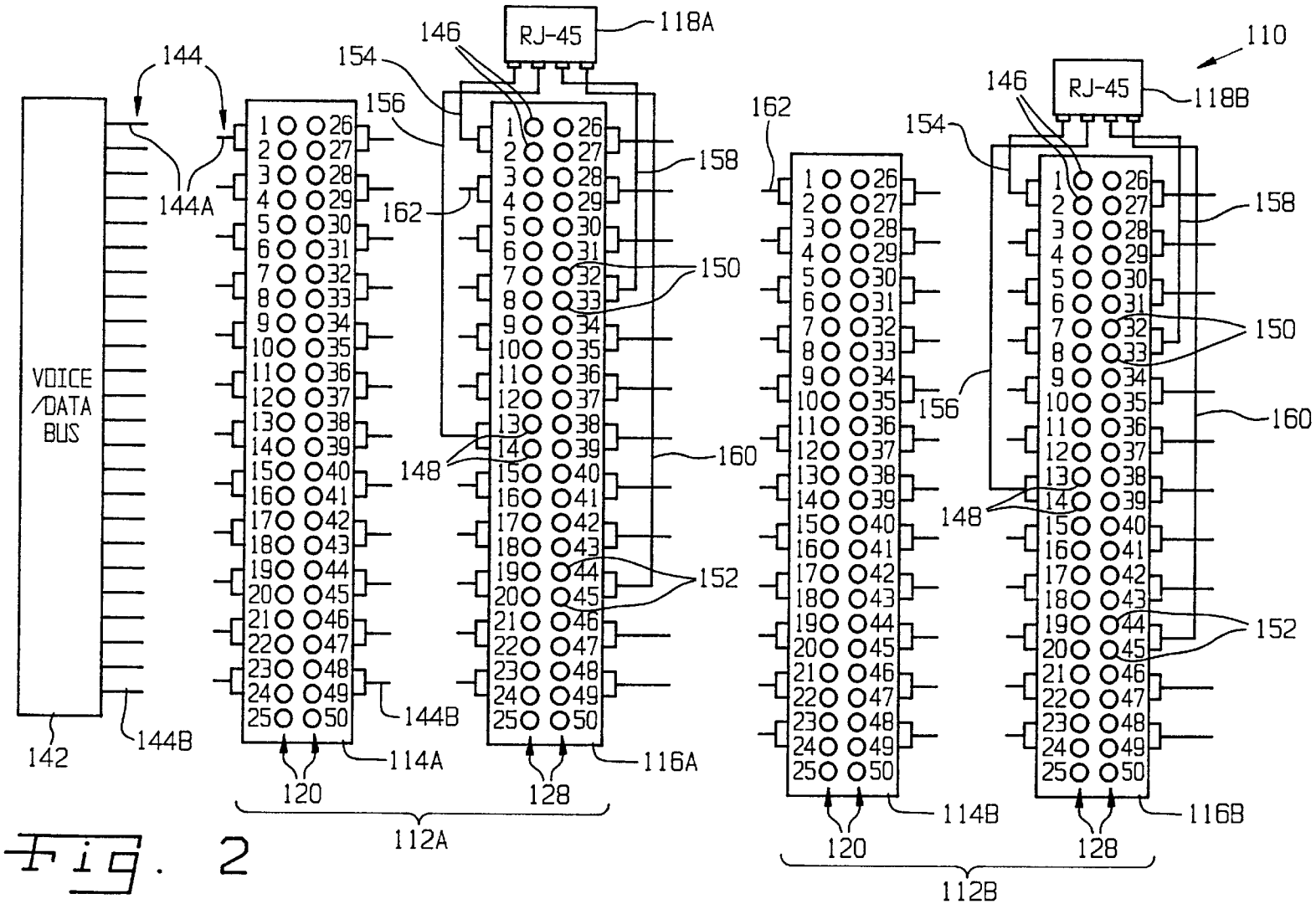
FIGS. 2 and 3 illustrate an embodiment of a pinout arrangement of a communication system of the present invention using the communication connector assembly of FIG. 1.
Figure 3:
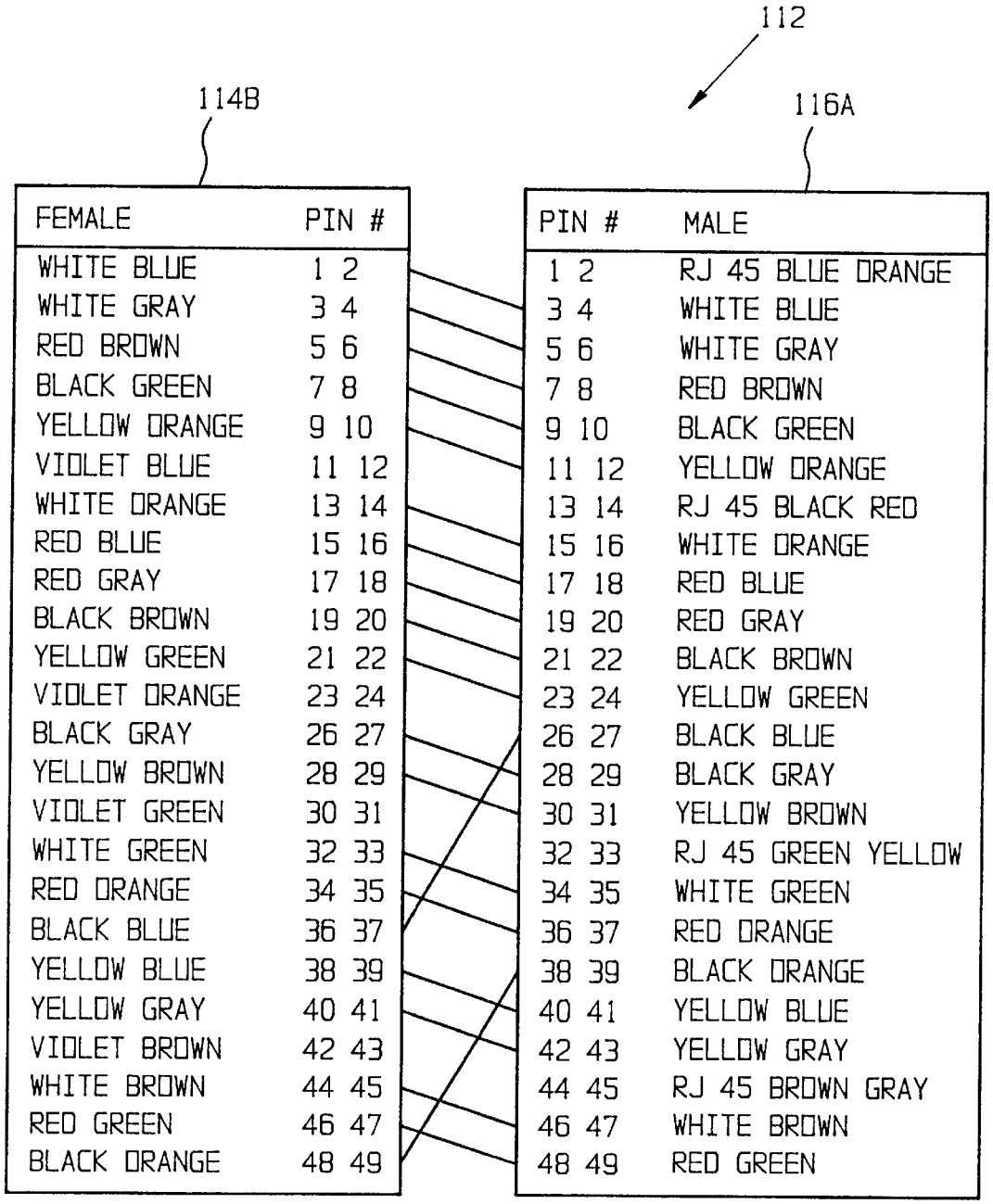

Referring now to FIGS. 2 and 3, conjunctively, a pinout arrangement of the pins or terminals 120 and 128 of first connector 114 and second connector 116, respectively, will be described in greater detail. First connector 114 and second connector 116 each include fifty pins or terminals, with each individual terminal being respectively referenced 1–50 in FIGS. 2 and 3. Terminals 25 and 50 of each connector are unused in the illustrated embodiment. The lines interconnecting first connector 114 and second connector 116 in FIG. 3 illustrate the stepping sequence for the four separate arrays of terminals associated with each breakout terminal pair, as will be described in more detail hereinafter.

Communication cable connector assemblies 112, individually referenced 112A and 112B in FIG. 2, correspond to locations at which a user desires to connect with communication system 110. Communication cable connector assemblies 112A and 112B may be located within a single workstation, or may be located within different workstations within the office environment. Communication cable connector assembly 112A, including first connector 114A and second connector 116A is connected with a voice/data bus 142 which carries voice and/or data signals. Voice/data bus 142 may be located, e.g., within an access closet within the office environment. Voice/data bus 142 is connected with first connector 114A via respective twisted wire pairs 144, one of which is individually referenced 144A. Twisted wire pair 144A (the white/blue twisted wire pair in FIG. 3) is connected with terminals 1 and 2 of first connector 114A. The next twisted wire pair (white/gray) is connected with terminals 3 and 4, the next twisted wire pair (red/brown) is connected with terminals 5 and 6, and so on with the last wire pair 144B (black/orange) being connected with terminals 48 and 49. When mated together, terminals 1–50 of connector 114A contact with terminals 1–50 of second connector 116A. Thus, first connector 114A is the "upstream" connector, and the second connector 116A to which it is mated is the "downstream" connector.

The pinout arrangement of second connector 116A provides both a stepped wiring arrangement between communication cable connector assemblies 112A and 112B, as well as reduced crosstalk between adjacent breakout terminal pairs. More particularly, second connector 116A includes 24 pairs of terminals associated with terminals 1–24 and 26–49, with terminals 25 and 50 being unused. The first terminal pair 146 is associated with terminals 1 and 2, the second terminal pair is associated with terminals 3 and 4 and so on, with the last terminal pair being associated with terminals 48 and 49. The particular terminal pairs which are connected with RJ-45 connector 118A are referred to as breakout terminal pairs, with each of the breakout terminal pairs being connected via a corresponding twisted wire pair with the eight terminals of RJ-45 connector 118A.

In contrast with the wiring arrangement described in U.S. Pat. No. 5,160,276 (Marsh, et al.), which includes breakout terminal pairs which are disposed sequentially longitudinally adjacent to each other within a single row of terminals, the breakout terminal pairs of second connector 116A are spaced apart from each other both longitudinally (i.e., within the same row of terminals) as well as laterally (from one row of terminals to another). More particularly, a first breakout terminal pair 146 corresponds to terminals 1 and 2; a second breakout terminal pair 148 corresponds to terminals 13 and 14; a third break out terminal pair 150 corresponds to terminals 32 and 33; and a fourth breakout terminal pair 152 corresponds to terminals 44 and 45. First breakout terminal pair 146 is connected via a twisted wire pair 154 with two corresponding terminals of RJ-45 connector 118A; second breakout terminal pair 148 is connected via twisted wire pair 156 with two corresponding terminals of RJ-45 connector 118A; third breakout terminal pair 150 is connected via twisted wire pair 158 with two corresponding terminals of RJ-45 connector 118A; and fourth breakout terminal pair 152 is connected via twisted wire pair 160 with two corresponding terminals of RJ-45 connector 118A. Breakout terminal pairs 146, 148, 150 and 152 may be selectively used in any desired combination to transmit voice and/or data signals to an associated RJ-45 connector 118.

Since the spacing between adjacent terminals within the same longitudinal row of terminals is much smaller than the spacing between laterally adjacent terminals in different rows, it has been found that separating the breakout terminal pairs within the same row of terminals is the most important design criteria for reducing crosstalk. However, separating the breakout terminal pairs in a lateral direction between adjacent rows of terminals has also been found to provide improved reduced crosstalk. Thus, although it is possible that third breakout terminal pair 150 could correspond to terminals 26 and 27 because of the larger distance in the lateral direction between terminals 1, 2 and 26, 27, improved reduced crosstalk may be provided by positioning the breakout terminal pairs such that they are neither laterally nor longitudinally adjacent relative to each other.

The interconnection between each second connector 116 and a following first connector 114 is a modified, stepped arrangement. That is, the interconnection between terminal pairs of a second connector 116 with the terminal pairs of a following first connector 114 is such that the same breakout terminal pairs are used on each second connector 116 for connection with a corresponding first breakout connector 118. However, the terminal pairs do not merely step up or down a distance corresponding to one pair for each breakout of second connector 116. Rather, the interconnections between terminal pairs of a second connector 116 with a following first connector 114 are a modified, stepped wiring arrangement which is consistent from one communication cable connector assembly 112 to another such that the same breakout terminal pairs are used in association with each breakout connector 118.

First connector 114A is connected via twisted wire pairs 144 with voice/data bus 142 as shown in FIG. 3. More particularly, terminals 1, 2 are connected with the white/blue twisted wire pair; terminals 3, 4 are connected with the white/gray twisted wire pair; terminals 5, 6 are connected with the red/brown twisted wire pair; terminals 7, 8 are connected with the black/green twisted wire pair; terminals 9, 10 are connected with the yellow/orange twisted wire pair; and terminals 11, 12 are connected with the violet/blue twisted wire pair. Twisted wire pair 144A therefore corresponds to a white/blue twisted wire pair. Terminals 1–12 of first connector 114A are of course connected with respective terminals 1–12 of second connector 116A. Terminals 11, 12 of second connector 116A are connected via a yellow/orange twisted wire pair with terminals 9, 10 of first connector 114B. Terminals 11, 12 of second connector 116A are therefore connected in a stepped up fashion with terminals 9, 10 of first connector 114B. Voice or data signals which were originally transmitted over the violet/blue twisted wire pair connected to terminals 11, 12 of first connector 114A are therefore transmitted over terminals 9, 10 of first connector 114B. Thus, aside from the feeder cable 144 which interconnects voice/data bus 142 with first connector 114A, the violet/blue twisted wire pair is no longer used in communication system 10.

The stepped up interconnection between second connector 116A and first connector 114B also is carried out for the five other terminal pairs associated with terminals 1–10. For example, the yellow/orange twisted wire pair connected with terminals 9, 10 of first connector 114A are coupled in a stepped up fashion with terminals 7, 8 of first connector 114B via the black/green twisted wire pair interconnecting terminals 9, 10 of second connector 116A with terminals 7, 8 of first connector 114B. Similarly, the white/gray twisted wire pair connected with terminals 3, 4 of first connector 114A is coupled with terminals 1, 2 of first connector 114B via the white/blue twisted wire pair interconnecting terminals 3, 4 of second connector 116A with terminals 1, 2 of first connector 114B.

The stepping sequence for terminals 13–24 associated with breakout terminal pair 148 is similar to that described above with reference to breakout terminal pair 146, and thus will not be described in detail.

For the third breakout terminal pair 150 associated with terminals 32 and 33 of second connector 116A, the stepping sequence is slightly different. To wit, breakout terminal pair 32, 33 of second connector 116A are connected with terminal pair 32, 33 of first connector 114A, which in turn is connected with a white/green twisted wire pair 144 in the feeder cable 144 between voice/data bus 142 and first connector 114A. At the second communication cable connector assembly 112B associated with second breakout connector 118B, terminals 32 and 33 of second connector 116B are coupled with the red/orange twisted wire pair 144 through the stepped up connection with the white/green twisted wire pair between terminals 34, 35 of second connector 116A and terminals 32, 33 of first connector 114B. At the fourth workstation 112D (FIG. 4), breakout terminals 32, 33 of second connector 116D are connected with the black/gray twisted wire pair 144 originally connected with terminal pair 26, 27 of first connector 114A. Similarly, at the sixth and last workstation 112F in communication system 110, breakout terminal pair 32, 33 of the second connector 116F is coupled with the violet/green twisted wire pair 144 connected with terminals 30, 31 of first connector 114A.

The stepping sequence for terminals 38–49 associated with breakout terminal pair 152 is similar to that described above with reference to breakout terminal pair 150, and thus will not be described in detail.

Figure 4:
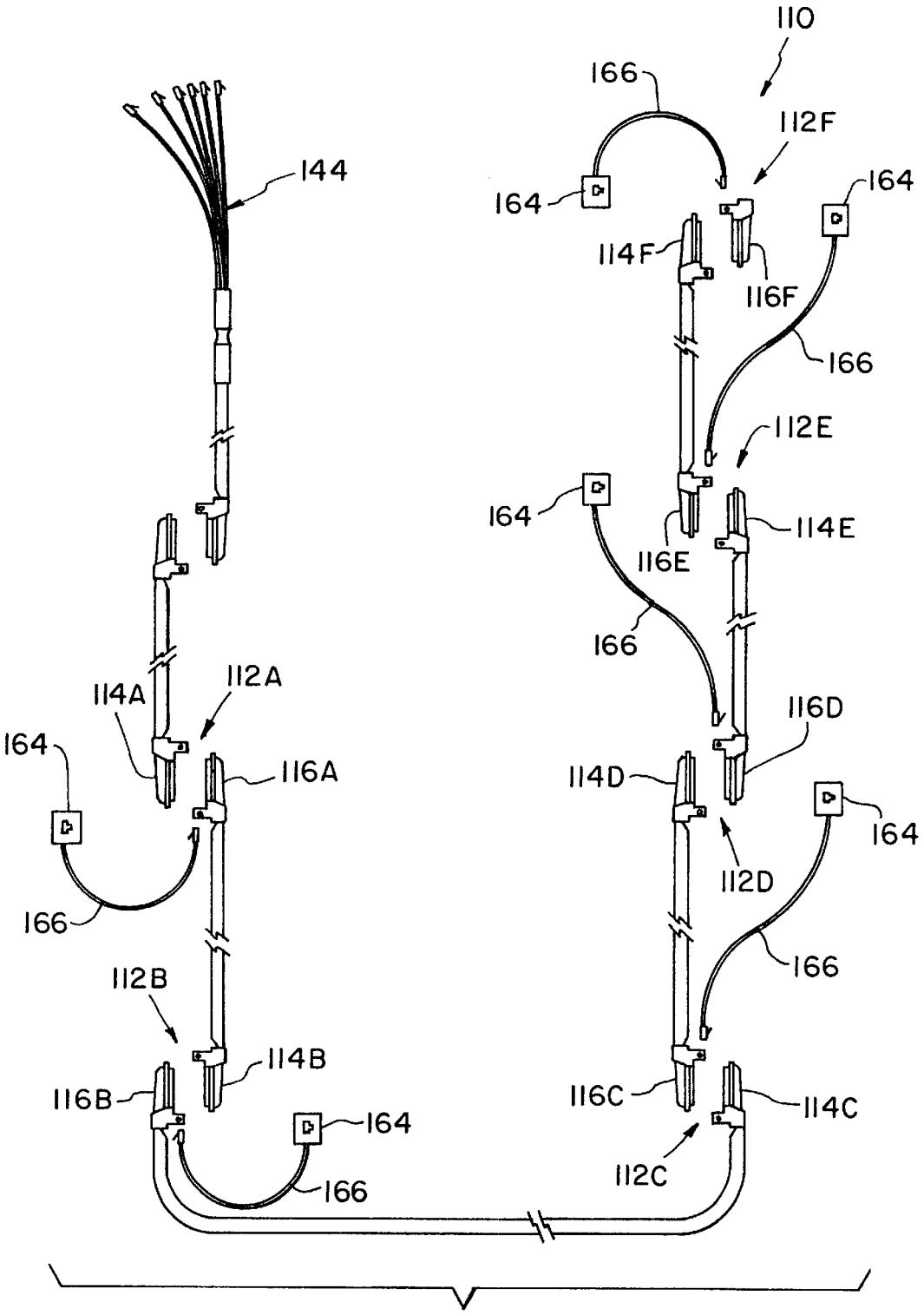
FIG. 4 illustrates one embodiment of a layout of the communication system of FIGS. 2 and 3 including six breakouts.

FIG. 4 is a simplified illustration of one embodiment of the communication system 110 of the present invention including six communication cable connector assemblies 112A–112F corresponding to six breakout locations designated by a user. The length of each electrical cable with the twisted wire pairs therein which interconnect a second connector 116 at one breakout location with a first connector 114 of another breakout location of course may vary depending upon the particular application. Second connector 116F is slightly different from the remaining second connectors 116A–116E, in that second connector 116F is for use with the last breakout location and therefore is not attached with twisted wire pairs in an electrical cable.

Although the embodiment of communication system 110 shown in FIGS. 2–4 includes a specified number of workstations with a predetermined number of breakout connectors, breakout terminal pairs and stepping sequence for each connector pair, it is also to be appreciated that the number of workstations, breakout connectors at each workstation, breakout terminal pairs associated with each breakout connector and/or stepping sequence of each connector pair may vary for the particular application with which communication system 110 is used. Regardless of the particular application, communication system 110 has a wiring arrangement with a modified stepped sequence wherein the breakout terminal pairs are spaced apart from each other at least within the same row, and preferably also between rows, to reduce crosstalk between breakout terminal pairs.

Figure 5:
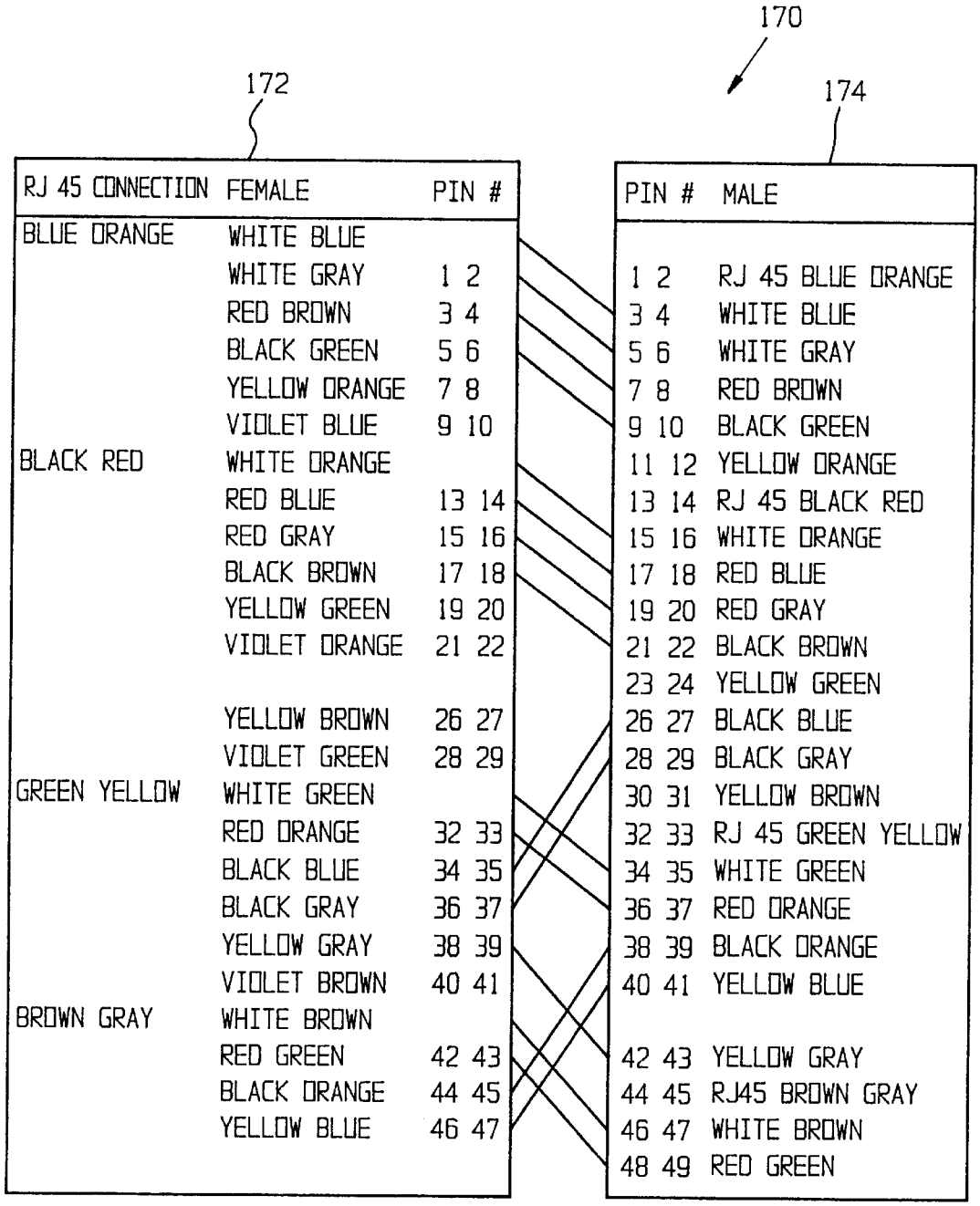
FIG. 5 is a schematic illustration of another embodiment of a pinout arrangement of a communication system of the present invention.

Referring now to FIG. 5, there is shown a schematic illustration of another embodiment of a wiring arrangement for a communication cable connector assembly 170 for use with a communication system of the present invention. Communication cable connector assembly 170 includes a female, first connector 172 and a male, second connector 174. Second connector 174 includes four breakout terminal wire pairs associated with a first breakout connector in the form of an RJ-45 connector, similar to breakout connector 118 shown with reference to communication system 110 described with reference to FIGS. 2–4. However, first connector 172 also includes a second breakout connector in the form of an RJ-45 connector. The second breakout connector of first connector 172 is not directly electrically connected to any of the terminals of first connector 172, however. Rather, the terminals of the second breakout connector of first connector 172 are connected to the terminals of the second connector 174 which is directly upstream from first connector 172. Thus, each workstation of the communication system including communication cable connector assembly 170 includes two breakout connectors for use by the user. One of the breakout connectors may be used, e.g., for voice signals and the other breakout connector may be used, e.g., for computer data signals.

First connector 172 and second connector 174 include fifty terminals each which are divided into separate four pair arrays of terminals. The four pair arrays of terminals are respectively associated with a breakout terminal pair of the RJ-45 connector associated with each communication cable connector 170. Each array of terminals has a stepping sequence which is the same for each communication cable connector assembly 170 within the communication system. The lines extending between first connector 172 and second connector 174 again represent the stepping sequence of the twisted wire pairs used in the wiring arrangement of communication cable connector assembly 170. In the particular embodiment shown in FIG. 5, the communication system may include a maximum of three workstations with two breakout connectors per workstation and four breakout terminal pairs associated with each breakout connector.

Second connector 174 includes a first array of terminals 1–10 associated with two respective and separate blue/orange twisted wire pairs which are in turn associated with two separate RJ-45 connectors. More particularly, terminals 1–2 are associated with a blue/orange twisted wire pair which is in turn associated with an RJ-45 connector disposed within second connector 174. Terminals 3–4 are associated with a white/blue twisted wire pair which is splice connected to another blue/orange twisted wire pair. This second blue/orange twisted wire pair is in turn associated with an RJ-45 connector disposed within the first connector 172 that is directly downstream from the second connector 174. For the first workstation, the white/blue twisted wire pair extending from the voice/data bus is spliced directly to the blue/orange twisted wire pair of the RJ-45 connector. Between the first and second workstations, the white/blue twisted wire pair associated with terminals 3, 4 of second connector 174 is again spliced with the blue/orange twisted wire pair of the RJ-45 connector of first connector 172. Thus, signals originally transmitted over the red/brown twisted wire pair from the voice/data bus are stepped up to be connected with the blue/orange twisted wire pair at the second workstation. Similarly, signals transmitted over the yellow/orange twisted wire pair from the voice/data bus are stepped up to terminals 3, 4 of a first connector 172 at the second workstation through the interconnection with the red/brown twisted wire pair. Accordingly, at the third workstation, signals originally transmitted over the yellow/orange twisted wire pair from the voice/data bus are connected with the blue/orange twisted wire pair at the third workstation. For the RJ-45 connector of the second connector 174 of each of the three workstations, it will be appreciated that the stepping sequence shown provides respective interconnection with the signals transmitted over the white/gray, black/green and violet/blue twisted wire pairs from the voice/data bus.

The stepping sequence for the second array of terminals associated with the two black/red twisted wire pairs of each RJ-45 connector is substantially the same as that described above with reference to terminals 1–10, and thus will not be described in detail.

Using the same logic as described above, the stepping sequence for the two breakout terminal pairs associated with the two green/yellow twisted wires of the two RJ-45 connectors, as well as the breakout terminal pairs associated with the brown/gray twisted wires of the two RJ-45 connectors may be easily ascertained. To wit, signals transmitted over white/green, black/blue and yellow/brown twisted wire pairs from the voice/data bus are respectively connected with the green/yellow twisted pair of the RJ-45 connector associated with each respective first connector 172 of the communication system. Similarly, signals transmitted over the red/orange, black/gray and violet/green twisted wire pairs from the voice/data bus are respectively connected with the green/yellow twisted wire pair of the RJ-45 connector associated with each respective second connector of the communication system.

A similar stepping sequence is shown for the last array of terminals associated with the two brown/gray twisted wire pairs, and will not be described in further detail.

Figure 6:
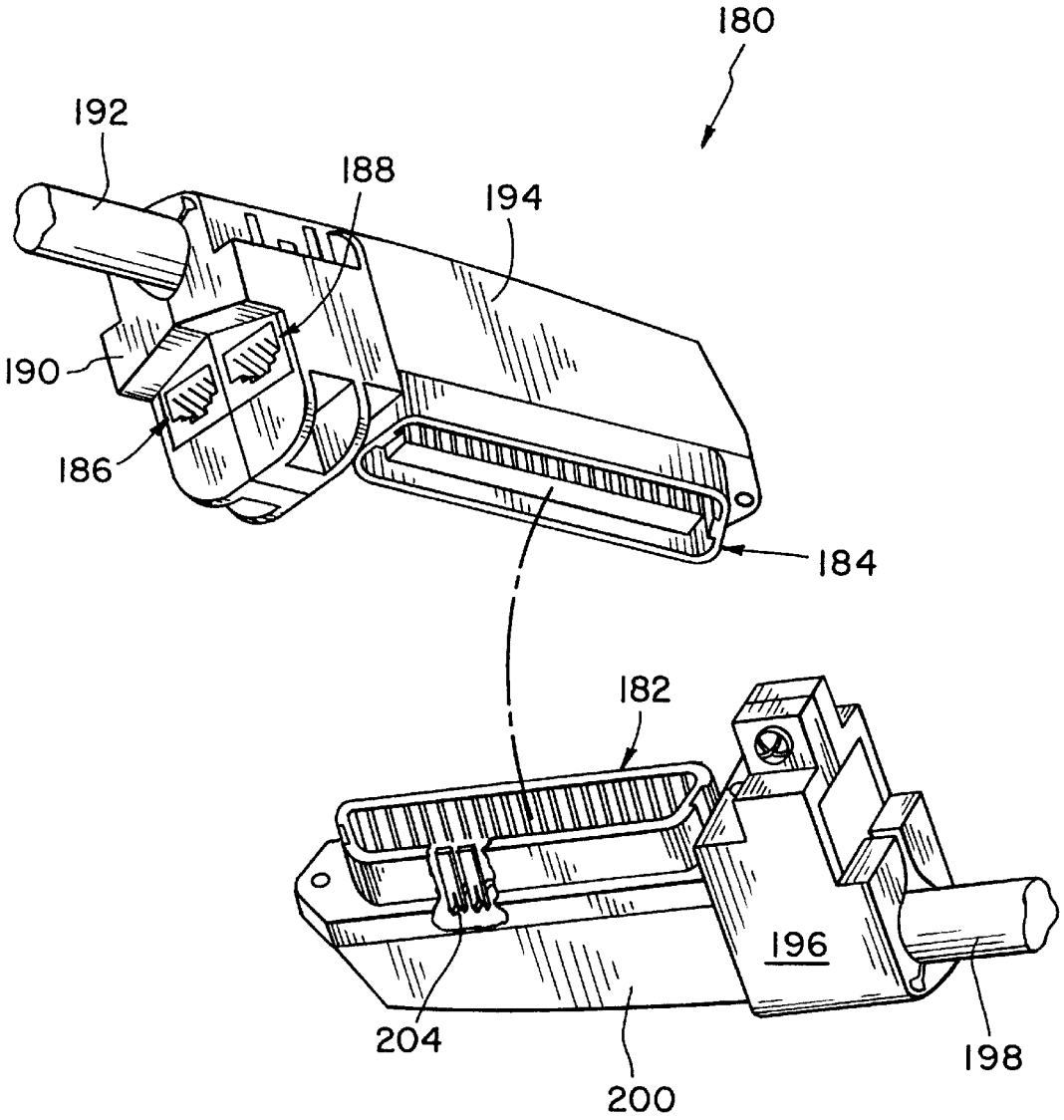
FIG. 6 is a perspective view of another embodiment of a communication connector assembly of the present invention including a male and female connector in a disassembled state.

Referring now to FIG. 6, there is shown another embodiment of a communication cable connector assembly for use with a communication system of the present invention. Communication cable connector assembly 180 includes a female, first connector 182 which is substantially identical to first: connector 114 of FIG. 1. However, a male, second connector 134 has a first breakout connector 186 and a second breakout connector 188, in contrast to the single breakout connector 118 on second connector 116 of FIG. 1. Breakout connectors 186 and 188, both in the form of an RJ-45 connector, are disposed within a clamp 190 which secures cable 192 to housing 194. Similarly, a clamp 196 secures cable 198 to a housing 200 which is associated with first connector 182.

Figure 7:
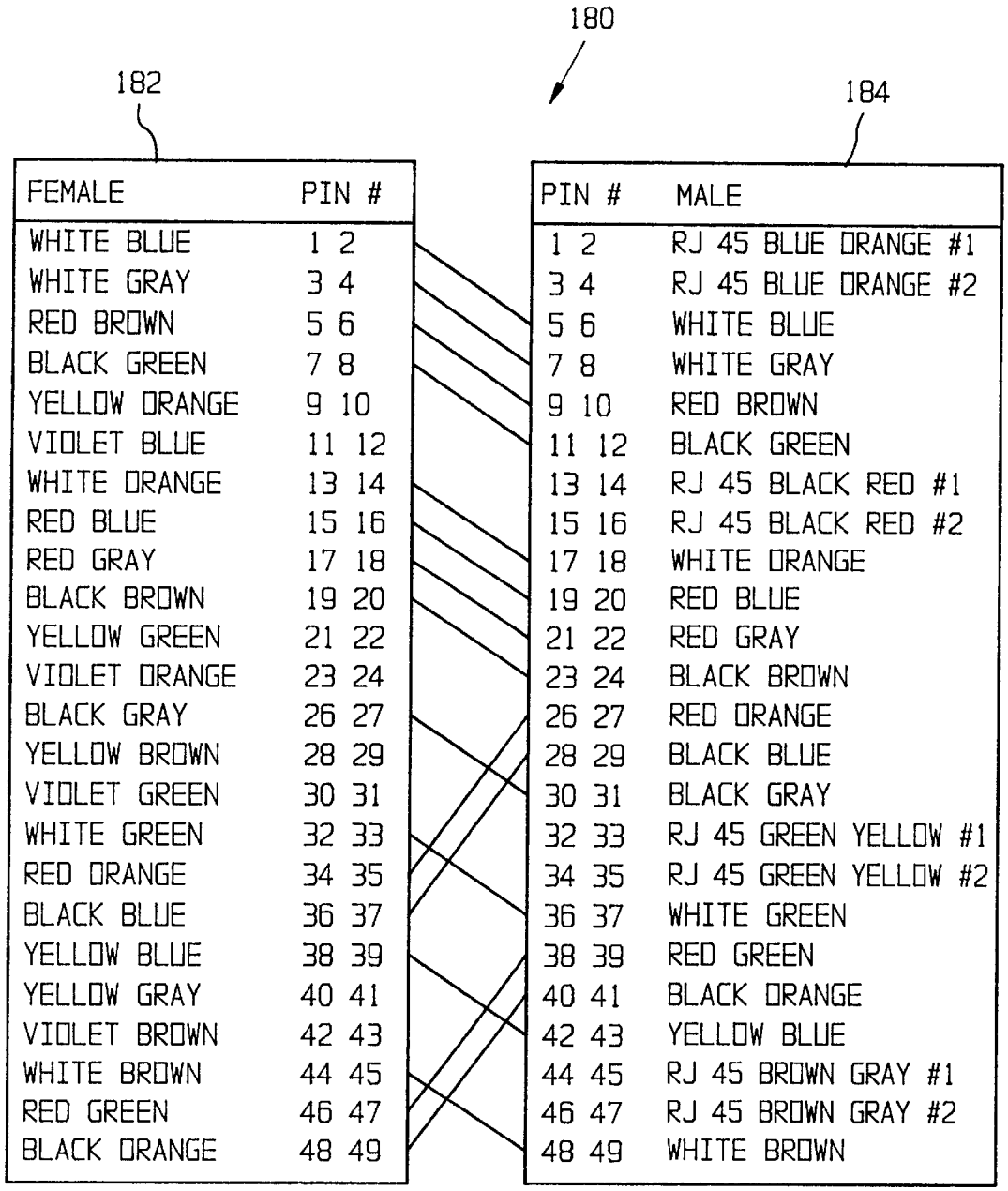
FIG. 7 is a schematic illustration of yet another embodiment of a pinout arrangement of a communication system of the present invention using the communication connector assembly of FIG. 6.
Figure 8:
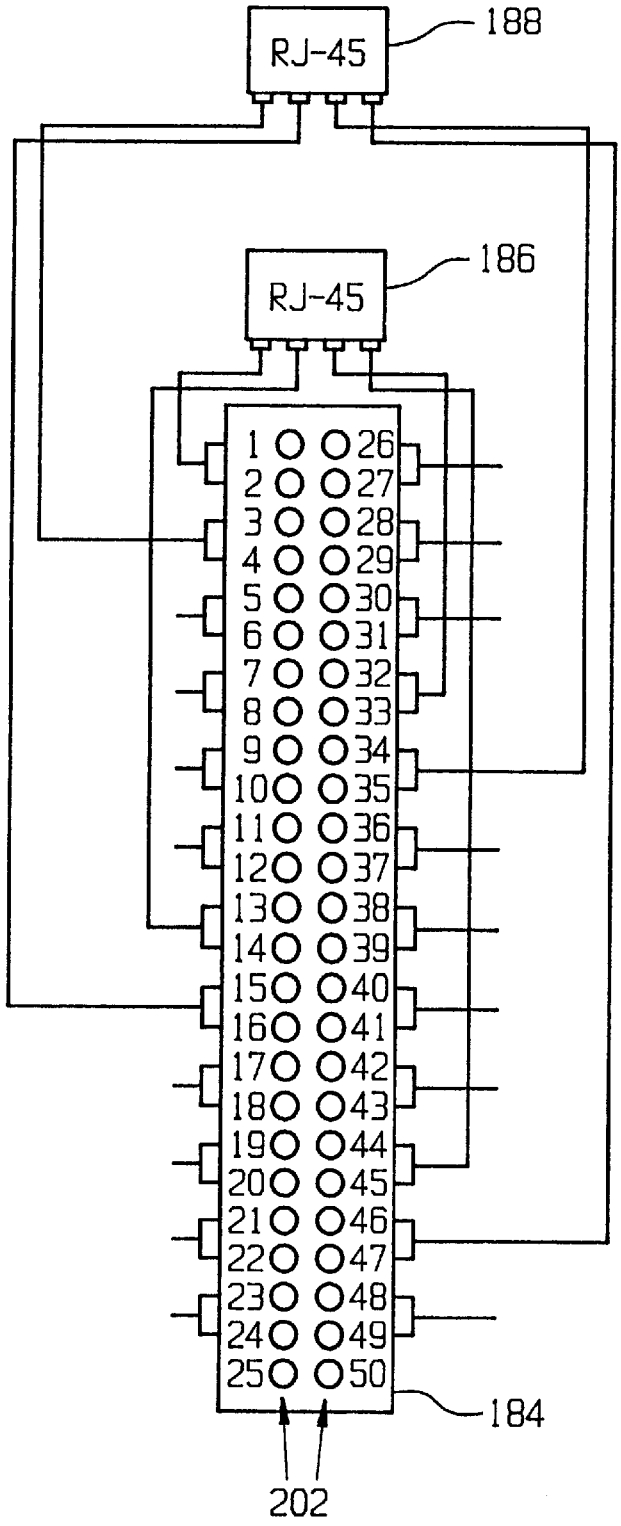
FIG. 8 illustrates the pinout arrangement of the male connector of the embodiment of FIG. 7.

FIG. 7 is a schematic illustration of a wiring arrangement for communication cable connector assembly 180 of FIG. 6. Second connector 184 includes fifty terminals 202 (FIG. 8), a first subset of which define four first breakout terminal wire pairs associated with first breakout connector 186. This first subset includes terminals 1–2, 13–14, 32–33 and 44–45. Second connector 184 also includes a second subset of terminals which define four second breakout terminal wire pairs associated with second breakout connector 188. This second subset includes terminals 3–4, 15–16, 34–35 and 46–47. Thus, each workstation of the communication system including communication cable connector assembly 180 includes two breakout connectors for use by the user. One of the breakout connectors may be used, e.g., for voice signals and the other breakout connector may be used, e.g., for computer data signals. FIG. 8 shows the pinout arrangement associated with the wiring arrangement of FIG. 7. The voice/data bus and first connector 182 are not shown for ease of illustration; however, their pinout arrangements are substantially the same as shown in FIG. 2.

The wiring arrangements and stepping sequences of first connector 182 and second connector 184 are substantially similar to that shown in FIG. 5. The fundamental difference between the embodiment of FIG. 5 and the embodiment of FIGS. 6–8 is that in the embodiment of FIG. 5, one of the two breakout connectors is disposed in a female connector and the other of the two breakout connectors is disposed in a male connector. Since each female connector is upstream relative to the male connector to which it is mated, certain wires of voice/data bus 142 must be spliced to the twisted wire pairs of an RJ-45 connector that is disposed within the most upstream of the female connectors 172. Furthermore, at each subsequent workstation, certain wires leading from the male connector of the upstream workstation must be spliced to the twisted wire pairs of the RJ-45 connector disposed within the female connector of the downstream workstation. In contrast, the embodiment of FIGS. 6–8 is manufactured by using the technique of pressing connector terminals into the twisted wire pairs of the RJ-45 connector to thereby make electrical connections, perhaps by piercing through PVC insulation surrounding the wires. An example of the electrical connections produced by this method is shown in the fragmentary portion of FIG. 6 as an electrical connection 204 within female, first connector 182.

By positioning each of first breakout connector 186 and second breakout connector 188 within close proximity of second connector 184, it is possible to easily and economically press the terminals of second connector 184 into the twisted wire pairs connected to the terminals of breakout connectors 186 and 188. In any case, a certain number of the terminals of each connector 182 and of each connector 184 must be pressed into wires leading to or from another connector, or from the voice/data bus. Thus, by pressing the terminals of male, second connector 184 into the twisted wire pairs of the RJ-45 connectors, the embodiment of FIGS. 6–8 eliminates the additional manufacturing step of splicing the wires associated with the RJ-45 connector to other wires leading from the voice/data bus or from a male, second connector 184.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A communication cable connector assembly, comprising:

a first connector having a plurality of first terminals;

a second connector having a plurality of second terminals with a plurality of pairs of adjacent terminals, each of said plurality of second terminals mating with a corresponding one of said plurality of first terminals, a first subset of said pairs of adjacent terminals defining first breakout terminal pairs, said first breakout terminal pairs being non-adjacent relative to each other, a second subset of said adjacent pairs of terminals defining second breakout terminal pairs, said second breakout terminal pairs being non-adjacent relative to each other;

a first breakout connector associated with said second connector, said first breakout connector having a plurality of third terminals connected with said first breakout terminal pairs of said second connector; and a second breakout connector associated with said second connector, said second breakout connector having a plurality of fourth terminals connected with said second breakout terminal pairs of said second connector.

2. The communication cable connector assembly of claim 1, wherein said plurality of second terminals are arranged in two longitudinal rows of terminals, said two rows of terminals being laterally adjacent to each other, each said adjacent pair of terminals being a longitudinally adjacent pair of terminals.

3. A communication cable connector assembly, comprising:

a first connector having a plurality of first terminals;

a second connector having a plurality of second terminals with a plurality of pairs of adjacent terminals, each of said plurality of second terminals mating with a corresponding one of said plurality of first terminals, said plurality of second terminals being arranged in two longitudinal rows of terminals, said plurality of second terminals being arranged in two longitudinal rows of terminals, said two rows of terminals being laterally adjacent to each other, a first subset of said pairs of adjacent terminals defining first breakout terminal pairs, said first breakout terminal pairs being non-adjacent relative to each other, said first breakout terminal pairs consisting of four first breakout terminal pairs, two of said first breakout terminal pairs being in one of said two rows of terminals and a remaining two of said first breakout terminal pairs being in an other of said two rows of terminals, a second subset of said adjacent pairs of terminals defining second breakout terminal pairs, said second breakout terminal pairs being non-adjacent relative to each other, said second breakout terminal pairs consisting of four second breakout terminal pairs, two of said second breakout terminal pairs being in one of said two rows of terminals and a remaining two of said second breakout terminal pairs being in an other of said two rows of terminals;

a first breakout connector associated with said second connector, said first breakout connector having a plurality of third terminals connected with said first breakout terminal pairs of said second connector; and a second breakout connector associated with said second connector, said second breakout connector having a plurality of fourth terminals connected with said second breakout terminal pairs of said second connector.

4. The communication cable connector assembly of claim 3, wherein each said adjacent pair of terminals is a longitudinally adjacent pair of terminals, and wherein said first breakout terminal pairs within each said row are spaced a first substantially equal distance apart and said second breakout terminal pairs within each said row are spaced a second substantially equal distance apart.

5. The communication cable connector assembly of claim 4, wherein said plurality of second terminals consist of fifty terminals, and wherein said first breakout terminal pairs within each said row are spaced apart a distance corresponding to approximately six terminals in the longitudinal direction and said second breakout terminal pairs within each said row are spaced apart a distance corresponding to approximately six terminals in the longitudinal direction.

6. The communication cable connector assembly of claim 3, wherein said two first breakout terminal pairs located in said one row of terminals are not laterally adjacent to said two first breakout terminal pairs located in said other row of terminals and said two second breakout terminal pairs located in said one row of terminals are not laterally adjacent to said two second breakout terminal pairs located in said other row of terminals.

7. The communication cable connector assembly of claim 1, wherein said plurality of second terminals are arranged in at least one longitudinal row of terminals, said plurality of second terminals being divided into a plurality of arrays of terminals which are longitudinally adjacent to each other, each said array including a plurality of said adjacent pairs of terminals, each said first breakout terminal pair being in a different one of said plurality of arrays and each said second breakout terminal pair being in a different one of said plurality of arrays.

8. The communication cable connector assembly of claim 1, further comprising a plurality of twisted wire pairs, each of said twisted wire pairs being associated with a respective said adjacent pair of terminals.

9. The communication cable connector assembly of claim 1, wherein said plurality of third terminals of said first breakout connector define a plurality of first terminal pairs and said plurality of fourth terminals of said second breakout connector define a plurality of second terminal pairs, each said first terminal pair of said first breakout connector and each said second terminal pair of said second breakout connector being connected with a respective said breakout terminal pair of said second connector.

10. The communication cable connector assembly of claim 1, wherein each of said first breakout connector and said second breakout connector comprises an RJ-45 connector.

11. The communication connector assembly of claim 1, wherein said first breakout connector and second breakout connector are each carried by a common housing of the second connector.

12. A communication cable connector assembly for connection with a first connector having a plurality of first terminals for receiving at least one of voice and data signals, said communication cable connector assembly comprising:

a second connector having a plurality of second terminals with a plurality of pairs of adjacent terminals, each of said plurality of second terminals being configured for mating with a corresponding one of the plurality of first terminals of the first connector, a first subset of said pairs of adjacent terminals defining first breakout terminal pairs, said first breakout terminal pairs being non-adjacent relative to each other, a second subset of said pairs of adjacent terminals defining second breakout terminal pairs, said second breakout terminal pairs being non-adjacent relative to each other;

a first breakout connector associated with said second connector, said first breakout connector having a plurality of third terminals connected with said first breakout terminal pairs of said second connector; and a second breakout connector associated with said second connector, said second breakout connector having a plurality of fourth terminals connected with said second breakout terminal pairs of said second connector.

13. The communication connector assembly of claim 12, wherein said first breakout connector and said second breakout connector are each carried by a common housing of the second connector.

14. A communication cable connector assembly, comprising:

a first connector having a plurality of first terminals;

a cable assembly including a plurality of electrical conductors, at least one of said conductors being connected to a corresponding first terminal of said first conductor;

a second connector having a plurality of second terminals with a plurality of pairs of adjacent second terminals, each of said plurality of second terminals mating with a corresponding one of said plurality of first terminals;

a first breakout connector associated with said second connector, said first breakout connector having a plurality of third terminals, said third terminals being connected with selected non-adjacent pairs of adjacent second terminals of said second connector; and a second breakout connector associated with one of said first connector and said second connector, said second breakout connector having a plurality of fourth terminals, said fourth terminals being connected with one of selected said electrical conductors of said cable assembly and selected non-adjacent pairs of adjacent second terminals of said second connector.

15. A communication cable connector assembly, comprising:

a first connector having a plurality of first terminals;

a second connector having a plurality of second terminals with a plurality of pairs of adjacent terminals, each of said plurality of second terminals mating with a corresponding one of said plurality of first terminals, a first subset of said pairs of adjacent terminals defining first breakout terminal pairs, said first breakout terminal pairs being non-adjacent relative to each other, a second subset of said adjacent pairs of terminals defining second breakout terminal pairs, said second breakout terminal pairs being non-adjacent relative to each other;

a third connector having a plurality of third terminals, at lease one of said third terminals being connected with a respective said second terminal of said second connector;

a first breakout connector associated with said second connector, said first breakout connector having a plurality of fourth terminals connected with said first breakout terminal pairs of said second connector; and a second breakout connector associated with one of said second connector and said third connector, said second breakout connector having a plurality of fifth terminals connected with said second breakout terminal pairs of said second connector.

* * * * *

UNITED STATES PATENT AND TRADEMARK OFFICE

CERTIFICATE OF CORRECTION

PATENT NO. : 6,074,254
DATED : June 13, 2000
INVENTOR(S) : Jeff Schultz, et al.

It is certified that error appears in the above-identified patent and that said Letters Patent is hereby corrected as shown below:

Column 10,
Line 34, delete "said plurality of second terminals being arranged in two longitudinal rows of terminals,".

Signed and Sealed this

Eighteenth Day of September, 2001

*Attest:*

Nicholas P. Godici

NICHOLAS P. GODICI
*Acting Director of the United States Patent and Trademark Office*

*Attesting Officer*